US008414713B2

(12) United States Patent
Vartanov

(10) Patent No.: US 8,414,713 B2
(45) Date of Patent: Apr. 9, 2013

(54) HIGH STRENGTH MILITARY STEEL

(76) Inventor: Gregory Vartanov, Oakville (CA)

( * ) Notice: Subject to any disclaimer, the term of this patent is extended or adjusted under 35 U.S.C. 154(b) by 251 days.

(21) Appl. No.: 12/454,426

(22) Filed: May 18, 2009

(65) Prior Publication Data

US 2009/0291014 A1 Nov. 26, 2009

(51) Int. Cl.
*C22C 38/44* (2006.01)
*C22C 38/50* (2006.01)

(52) U.S. Cl. ..... 148/335; 420/109; 420/113; 420/115

(58) Field of Classification Search ..... 148/579–664, 148/320–337; 420/89–93, 104–116, 119, 420/122–127, 129
See application file for complete search history.

(56) References Cited

U.S. PATENT DOCUMENTS 3,453,152 A * 7/1969 Morse et al. ..... 148/621
5,454,883 A * 10/1995 Yoshie et al. ..... 148/320
2006/0137780 A1* 6/2006 Beguinot et al. ..... 148/664
2006/0162826 A1* 7/2006 Beguinot et al. ..... 148/664
2006/0196583 A1* 9/2006 Hayashi et al. ..... 148/330
2008/0264524 A1* 10/2008 Maruta et al. ..... 148/330

FOREIGN PATENT DOCUMENTS

WO WO2008/084108 * 7/2008

OTHER PUBLICATIONS

G. Krauss, "Tempering of Martensite," Encyclopedia of Materials: Science and Technology, vol. 10, copyright 2001, pp. 9093-9097.*

* cited by examiner

*Primary Examiner* — Scott Kastler
*Assistant Examiner* — Vanessa Luk
(74) *Attorney, Agent, or Firm* — Alex Rhodes

(57) ABSTRACT

A high hardness, high strength, and high impact toughness steel for military articles such as armor plates, bodies of deep penetrating bombs, and missiles. The steel has a HRC of 54 to 56, UTS of 290 to 305 ksi, YS of 225 to 235 ksi, an elongation of 13-14%, a reduction of area of 47-50% and a Charpy V-notch impact toughness energy of 26 to 28 ft-lbs at room temperature. The microstructure of the steel consists essentially of fine packets of martensitic lathes, fine titanium carbides as centers of growth of the martensitic lathes, and retained austenite.

9 Claims, 2 Drawing Sheets

| Sheet Alloying Element % weight | New Steel | Eglin Steel* |
|---|---|---|
| C | 0.3 to 0.45 | 0.16 to 0.35 |
| Cr | 1.0 to 3.0 | 1.50 to 3.25 |
| Mo | 0.1 to 0.55 | 0.55 max |
| W | 0.1 to 2.0 | 0.7 to 3.25 |
| Ni | 0.1 to less than 3.0 | 5.00 max |
| Mn | 0.1 to 1.0 | 0.85 max |
| Si | more than 0.3 to 1.0 | 1.25 max |
| Cu | 0.1 to 0.6 | 0.50 max |
| V | more than 0.1 to 0.55 | 0.05 to 0.30 |
| Ti or Nb | 0.02 to 0.2 | N.A. |
| Ca | N.A. | 0.02 max |
| N | N.A. | 0.14 max |
| Al | N.A. | 0.05 max |
| Fe | remainder | remainder |

*U.S. Patent 7,537,727 "Eglin Steel –A Low Alloy High Strength Composition"

| Sheet Alloying Element % weight | New Steel | Eglin Steel* |
|---|---|---|
| C | 0.3 to 0.45 | 0.16 to 0.35 |
| Cr | 1.0 to 3.0 | 1.50 to 3.25 |
| Mo | 0.1 to 0.55 | 0.55 max |
| W | 0.1 to 2.0 | 0.7 to 3.25 |
| Ni | 0.1 to less than 3.0 | 5.00 max |
| Mn | 0.1 to 1.0 | 0.85 max |
| Si | more than 0.3 to 1.0 | 1.25 max |
| Cu | 0.1 to 0.6 | 0.50 max |
| V | more than 0.1 to 0.55 | 0.05 to 0.30 |
| Ti or Nb | 0.02 to 0.2 | N.A. |
| Ca | N.A. | 0.02 max |
| N | N.A. | 0.14 max |
| Al | N.A. | 0.05 max |
| Fe | remainder | remainder |

*U.S. Patent 7,537,727 "Eglin Steel –A Low Alloy High Strength Composition"

Fig.1

| Mechanical Properties | Eglin Steel* | New Steel Quenched Low Tempered | New Steel Quenched Refrigerated Low Tempered | New Steel Quenched High Tempered |
|---|---|---|---|---|
| Rockwell Hardness Scale C | 46.6 | 52 - 54 | 54 - 56 | 48 - 50 |
| Ultimate Tensile Strength, (ksi) | 244.4 | 285 - 295 | 290 - 305 | 240 - 250 |
| Yield Strength, (ksi) | 201.9 | 215 - 220 | 225 - 235 | 225 - 235 |
| Elongation, (%) | 17.5 | 13 - 14 | 13 - 14 | 10 - 11 |
| Reduction of Area, (%) | N.A. | 48 - 50 | 47- 50 | 48 - 50 |
| Charpy V-notch Impact Toughness Energy (ft-lb) | 27.3 | 26 - 30 | 26-28 | 20 - 22 |

*U.S. Patent 7,537,727 "Eglin Steel –A Low Alloy High Strength Composition"

Fig.2

HIGH STRENGTH MILITARY STEEL

FIELD OF THE INVENTION

This invention relates to a high hardness, high strength, high impact toughness military steel and more particularly to a military steel with higher mechanical performance than Eglin steel.

BACKGROUND OF THE INVENTION

Large amounts of expensive high hardness, high strength, and high impact toughness military steels are used for purposes such as bunker buster bombs, missiles, tank bodies and aircraft landing gears.

Eglin Steel (U.S. Pat. No. 7,537,727, incorporated by reference) was a joint effort of the US Air Force and Ellwood National Forge Company program to develop a low cost replacement for the expensive high strength and high toughness steels, AF-1410, Aermet-100, HY-180, and HP9-4-20/30. One application of Eglin steel was the new bunker buster bombs, e.g. the Massive Ordnance Penetrator and the improved version of the GBU-28 bomb known as EGBU-28.

High strength is required to survive the high impact speeds that occur during deep penetration. Eglin steel was planned for a wide range of other applications, from missile and tank bodies to machine parts.

One shortcoming of Eglin steel is its limited mechanical properties for large manufactured products which are as follows:

Hardness (HRC), up to C48

Ultimate tensile strength (UTS), up to 250 ksi

Yield strength (YS) up to 210 ksi

Another shortcoming of Eglin steel is that its structural performance during impact tests of large articles, such as bunker buster bombs, vary somewhat below the impact test results of smaller laboratory products. The discrepancies in results are due to difficulties with heat treating of Eglin steel.

The present invention overcomes the shortcomings of Eglin steel by providing a steel that has higher mechanical properties and consistent results from chemical composition and heat treating. The improved steel has a medium carbon content, low nickel, molybdenum, and tungsten contents, and the strong carbide forming elements vanadium and titanium or niobium. The new alloying concentrations of vanadium, titanium or niobium, and tungsten affect the conditions of melting, processing, and heat treatment and as a result, it's higher mechanical properties.

One benefit of the new steel is higher performances of armor plate, deep penetrating bombs and missiles. Another benefit is that, at the same performance, less steel is required to match the performance of Eglin steel.

Another benefit of the invention is smaller amounts are required of the expensive elements nickel (Ni) and tungsten (W). The invention requires about 0.1 to less than 3.0% wt. of Ni and about 0.1 to 2.0% wt. of W, versus at most 5 max % wt. of Ni and 3.25 max % wt. of W for Eglin Steel.

SUMMARY OF THE INVENTION

The present invention is a military steel ("new steel") with higher levels of hardness, strength, and impact toughness than Eglin steel. The higher mechanical properties are due to optimizations of the following factors:

- selections of alloying compositions that supply high hardness, strength, and impact toughness
- selections of critical temperatures.

The hardness, strength and impact toughness of the invention was verified by the melting of laboratory and industrial scale ingots, processing of ingots from the melt, production of articles from the ingots, heat treating of the articles and mechanical testing of the articles.

The new steel differs from Eglin Steel by the following features:

- A microstructure of tempered dispersed lath martensite consisting of small packets of martensite laths grown on fine carbides and retained austenite, and packet boundaries free of carbides after quenching, low tempering or quenching, refrigerating, and low tempering.
- After quenching and low tempering, a Rockwell hardness of C52-54, an ultimate tensile strength of 285-295 ksi, a yield strength of 215-220 ksi, an elongation of 13-14%, a reduction of area of 48-50%, and a Charpy V-notch impact toughness energy of 26-30 ft-lb.
- After quenching, refrigerating, and low tempering, a Rockwell hardness of C54-56, an ultimate tensile strength of 290-305 ksi, a yield strength of 225-235 ksi, an elongation of 13-14%, a reduction of area of 47-50%, and a Charpy V-notch impact toughness energy of 26-28 ft-lb.
- After quenching and a second hardening by high tempering a microstructure consisting of a fine dispersion of titanium carbide (TiC) or niobium carbide (NbC), vanadium carbide (VC), and complex tungsten carbides, (MW).sub.xC.sub.y in a ferritic-martensitic-retained austenite matrix.
- After quenching and a second hardening by high tempering, a Rockwell hardness of C 48-50, an ultimate tensile strength of 240-250 ksi, a yield strength of 225-235 ksi, an elongation of 10-11%, a reduction of area of 48-50%, and a Charpy V-notch impact toughness energy of 20-22 ft-lb
- A high ductility and high formability during hot forging or rolling
- A use of only homogenized and recrystallization annealing without normalizing for the low tempered new steel
- A sum of alloying elements of that is less than the sum of alloying elements of Eglin steel
- Cost of charge materials of the new steel is less than cost of charge materials of Eglin steel.

The chemical compositions and mechanical properties of the invention and Eglin steel are compared in FIG. 1 and FIG. 2.

BRIEF DESCRIPTION OF THE DRAWINGS

FIG. 1 compares the chemical compositions of the new steel and Eglin Steel.

FIG. 2 compares the mechanical properties at room temperature of Eglin Steel and the invention after quenching and low tempering; after quenching, refrigerating, and low tempering; and after quenching and a second hardening by high tempering.

DETAILED DESCRIPTION OF THE INVENTION

The composition of the invention is comprised of: carbon (C); ferrite stabilizing chromium (Cr), molybdenum (Mo); silicon (Si); strong carbide forming tungsten (W), vanadium (V), and titanium (Ti) or niobium (Nb); austenite stabilizing nickel (Ni), manganese (Mn), copper (Cu); iron (Fe) and incidental impurities.

The carbon (C) content of 0.30 to 0.45% wt. supports the forming of carbides of tungsten (W), vanadium (V), titanium (Ti) or niobium (Nb), and complex carbides as centers of growth of martensite laths forming the microstructure of tempered dispersed lath martensite with retained austenite.

The chromium (Cr) content of 1.0 to 3.0% wt. increases strength, hardenability and temper resistance.

The molybdenum (Mo) content of 0.1 to 0.55% wt. improves hardenability, eliminates reversible temper brittleness, resists hydrogen attack & sulfur stress cracking, and increases elevated temperature strength.

The nickel (Ni) content of about 0.1% to less than 3.0% wt. supplies impact toughness The manganese (Mn) is a strong deoxidizing, and austenite stabilizing element. It's content is 0.1 to 1.0% wt.

The silicon (Si) strengthens the steel matrix by increasing the bonds between atoms in a solid solution. It protects the grain boundary from the growth of carbides, which decrease the toughness of the new steel. The content of Si is about more than 0.3% to 1.0% wt.

The copper (Cu) improves corrosion resistance, ductility, and machinability. The preferred content of Cu is 0.1 to 0.6% wt.

The tungsten (W) forms fine dispersed carbides, eliminates reversible temper brittleness, and increases hardness and temperature resistance. Its content is 0.1 to 2.0% wt.

The vanadium (V) affects on the structure and properties of the new steel in several ways. It forms finely dispersed particles of carbides in austenite which control the size and shape of grains by precipitating vanadium based, finely dispersed secondary carbides during high tempering and by affecting the kinetic and morphology of the austenite-martensite transformation. The concentration of V is about more than 0.1% to 0.55% wt.

The titanium (Ti) and niobium (Nb) are more active carbide forming elements than vanadium (V). Small concentrations of the strong carbide forming titanium (Ti) or niobium (Nb) do not affect the kinetics of phase transformations. A basic function of these elements is to inhibit austenite grain growth at high temperatures during heating. One element Ti or Nb is a part of the new steels. The concentration of Ti or Nb is 0.02 to 0.2% wt.

The balance of the new steel is iron (Fe) and incidental impurities.

Industrial scale ingots of the new steel were initially melted in an open induction furnace and then were melted in an electro-arc furnace (EAF), utilizing scrap and conventional charge materials. From the EAF, the steel was transported to a ladle refining furnace (LRF). In LRF the steel was reheated, refined from impurities, the necessary ingredients were added, and the steel was homogenized. Thereafter, the steel was transported to a vacuum de-gas station to remove hydrogen and nitrogen. Liquid steel was poured into molds. Ingots were subjected to homogenized annealing. Afterwards, the ingots were heated and forged to final size blanks. The blanks were subjected to re-crystallization annealing. Some ingots were subjected to normalizing and high tempering to eliminate the banding microstructure after the severe hot forging.

After austenizing at 1875-1925.degree. F. and further quenching and low tempering or quenching, refrigerating, and low tempering, a tempered martensite microstructure consisting essentially of martensitic lathes, fine titanium carbide, TiC or fine niobium carbide, NbC as centers of growth of the martensitic laths, and retained austenite was formed. The boundaries of the packets were free of carbides.

The second hardening of the new steel by high tempering consists of heating at 950-1200° F. for 5-7 hours to precipitate vanadium carbide, VC and complex tungsten carbides, $(MW)_xC_y$ as a fine dispersion.

After quenching and second hardening by high tempering, the new steel had a microstructure consisting of fine dispersion titanium carbide, TiC, or niobium carbide, NbC, vanadium carbide, VC, complex tungsten carbides, $(MW)_xC_y$. in a ferritic-martensitic-retained austenite matrix.

True production cost of the new steel is difficult to assess. However, based on data of the London Metal Exchange (LME), dated April, 2009, cost of charge materials of the new steel is at most 3,150 USD per metric ton, versus of Eglin steel at most 3,850 USD per metric ton.

EXAMPLES OF THE NEW STEEL

Example 1

The composition of the new steel is comprised of (%, wt): C=0.37, Cr=1.25, Ni=3.45, Mn=0.82, Cu=0.52, V=0.24, Si=0.91, Mo=0.52, Ti=0.11, and a balance of Fe and incidental impurities.

The new steel has the following critical temperatures, upper critical temperature $A_{C3}$, low critical temperature $A_{C1}$, and martensite start temperature $M_S$:

$A_{C3}$=1465° F., $A_{C1}$=1260° F., $M_S$=440° F.

Processing of laboratory scale ingots of the new steel consists of:

Homogenized annealing at 2100° F. for 6 hrs and air cooling

Hot rolling with a start temperature of 2150° F. and a finish temperature of 1850° F. and air cooling Recrystallization annealing at 1100° F. for 4 hrs Test specimens of the new steel are heat treated in the following manner:

Austenizing at 1900° F. for 60 min.

Oil quenching for 2.5 min. and further air cooled

Refrigerating at −60° F. for 60 min.

Tempering at 400° F. for 4 hrs.

The new steel has the following room temperature mechanical properties:

| HRC | UTS (ksi) | YS (ksi) | EL (%) | RA (%) | CVN (ft-lb) |
|---|---|---|---|---|---|
| 54 | 296 | 234 | 14 | 50 | 27.5 |

The new steel has a tempered martensite microstructure consisting of martensitic lathes, titanium carbides, TiC as centers of growth of the martensitic lathes, and 14 max % wt. of retained austenite. The boundaries of the packets are free of carbides.

Example 2

The composition of the new steel is comprised of (%, wt): C=0.35, Cr=1.32, W=0.52, Ni=2.66, Mn=0.85, Cu=0.51, V=0.26, Si=0.83, Mo=0.35, Ti=0.12, and a balance of Fe and incidental impurities.

The new steel has the following critical temperatures:

$A_{C3}$=1475° F., $A_{C1}$=1270° F., $M_S$=485° F.

Laboratory scale ingots of the new steel are processed the same as Example 1.

Test specimens of the new steel are heat treated in the following manner:

Austenizing at 1900° F. for 60 min.

Oil quenching for 2.5 min. and further air cooled

Refrigerating at −60° F. for 60 min.

Tempering at 450° F. for 4 hrs.

The new steel has the following room temperature mechanical properties:

| HRC | UTS (ksi) | YS (ksi) | EL (%) | RA (%) | CVN (ft-lb) |
|---|---|---|---|---|---|
| 55 | 301 | 233 | 13.5 | 49 | 26 |

The microstructure of the new steel is similar to the microstructure of Example 1 and has a retained austenite 11 max % wt.

Example 3

The composition of the new steel is comprised of (%, wt): C=0.32, Cr=1.24, W=0.82, Ni=2.52, Mn=0.86, Cu=0.53, V=0.25, Si=0.87, Mo=0.38, Ti=0.11, balance essentially Fe.

The new steel had the critical temperatures:

$A_{C3}$=1470° F., $A_{C1}$=1265° F., $M_S$=455° F.

Laboratory scale ingots of the new steel had the same processing as in Example 1.

Test specimens of the new steel was heat treated by the following mode:

Austenizing at 1900° F. for 60 min.

Oil quenching for 2.5 min. and further air cooled

Refrigerating at −60° F. for 60 min.

Tempering at 420° F. for 4 hrs.

The new steel has the following room temperature mechanical properties:

| HRC | UTS (ksi) | YS (ksi) | EL (%) | RA (%) | CVN (ft-lb) |
|---|---|---|---|---|---|
| 55 | 298 | 229 | 13.5 | 49 | 26 |

The new steel has a microstructure that is similar to the microstructure of Example 1 and has a retained austenite 9 max % wt.

Example 4

The composition of the new steel is comprised of (%, wt): C=0.37, Cr=1.61, Ni=0.54, Mn=0.41, Cu=0.29, V=0.54, Si=0.75, Mo=0.49, W=1.23, Ti=0.11, and a balance of Fe and incidental impurities.

The new steel has the following critical temperatures:

$A_{C3}$=1555° F., $A_{C1}$=1345° F., $M_S$=565° F.

Processing of laboratory scale ingots of the new steel is comprised of:

Homogenized annealing at 2100° F. for 6 hrs and air cooling

Hot rolling with a start temperature of 2150° F. and a finish temperature of 1850° F. and air cooling Recrystallization annealing at 1150° F. for 4 hrs Normalizing at 1925° F. for 4 hrs Test specimens of the new steel was heat treated by the following mode:

Austenizing at 1900° F. for 60 min.

Oil quenching for 2.5 min. and further air cooled

Second hardening by high tempering at 1070° F. for 3 hrs. and further high tempering at 1000° F. for 4 hrs.

The new steel has the following room temperature mechanical properties:

| HRC | UTS (ksi) | YS (ksi) | EL (%) | RA (%) | CVN (ft-lb) |
|---|---|---|---|---|---|
| 49 | 250 | 234 | 10 | 49 | 20.5 |

The new steel has a microstructure that consists essentially of a fine dispersion of titanium carbide, TiC, vanadium carbide, VC, complex tungsten carbides, $(MW)_xC_y$, in a ferritic-martensitic-retained austenite matrix.

Example 5

The composition of the new steel is comprised of (%, wt): C=0.35, Cr=1.43, Ni=0.69, Mn=0.43, Cu=0.31, V=0.52, Si=0.72, Mo=0.52, W=1.35, Ti=0.12, and balance essentially Fe.

The new steel has the following critical temperatures:

$A_{C3}$=1560° F., $A_{C1}$=1345° F., $M_S$=580° F.

Laboratory scale ingots of the new steel are processed the same as Example 4.

Test specimens of the new steel are heat treated in the same manner as Example 4.

The new steel has the following room temperature mechanical properties:

| HRC | UTS (ksi) | YS (ksi) | EL (%) | RA (%) | CVN (ft-lb) |
|---|---|---|---|---|---|
| 49 | 249 | 234 | 10 | 48 | 21 |

The new steel has a microstructure that is similar to the microstructures of Example 4.

From the above, it is apparent that the high hardness, high strength, high impact toughness steel which is the subject of the invention is an important development in the steel making art. Although only five examples have been described, it is obvious that other examples of the new steel can be derived from what is claimed in the presented description without departing from the spirit thereof.

What I claim is new is:

1. A high hardness, high strength and high impact toughness steel for armor plates, deep penetrating bombs and missiles comprising by % weight of about 0.3% to 0.45% of C, about 1.0% to 3.0% of Cr, about 0.1% to 0.55% of Mo, about 0.1% to 2.0% of W, about 0.1% to less than 3.0% of Ni, about 0.1% to 1.0% of Mn, about more than 0.3% to 1.0% of about 0.1% to 0.6% of Cu, about 0.02% to 0.2% of Ti or Nb, about more than 0.1% to 0.55% of V and a balance of Fe and incidental impurities, said steel having a dispersed tempered martensite microstructure comprised of packets of martensitic lathes, titanium carbides as centers of growth of said martensitic lathes, and retained austenite with boundaries of said packets free of carbides, said steel having a hardness of Rockwell C 54 to 56, an ultimate tensile strength of about 290 ksi to 305 ksi, a yield strength of about 225 ksi to 235 ksi, an elongation of about 13% to 14%, a reduction of area of about 47% to 50%, and a Charpy V-notch impact toughness energy of about 26 ft-lb to 28 ft-lb at room temperature.

2. The steel recited in claim 1, wherein said steel comprising by % weight of about 0.35% to 0.45% of C, about 1.0% to 2.5% of Cr, about 0.25% to 0.5% of Mo, about 0.1% to 1.0% of W, about 0.1% to 2.9% of Ni, about 0.1% to 0.8% of Mn, about 0.5% to 1.0% of Si, about 0.1% to 0.5% of Cu; about 0.02% to 0.15% of Ti or Nb, about 0.15% to 0.55% of V and a balance of Fe and incidental impurities.

3. The steel recited in claim 1, wherein said steel having 14 max % wt. of retained austenite.

4. A high hardness, high strength, and high impact toughness steel for armor plates, deep penetrating bombs and missiles having a dispersed tempered martensite microstructure comprised of packets of martensitic lathes, titanium carbides as centers of growth of said martensitic lathes, and retained austenite with boundaries of said packets free of carbides, said steel comprised of by % weight of about 0.3% to 0.45% of C, about 0.1% to 2.0% of W, about more than 0.1% to 0.55% of V, about 0.02% to 0.2% of Ti or Nb, the presence in an amount of 9.65 max % weight of the sum of Cr, Mo, Ni, Mn, Si, and Cu, and a balance of Fe and incidental impurities, said Ni having by % weight of about 0.1% to less than 3.0%, said Si having by % weight of about more than 0.3% to 1.0%, said steel having a hardness of Rockwell C 54 to 56, an ultimate tensile strength of 290 ksi to 305 ksi, a yield strength of 225 ksi to 235 ksi, an elongation of 13% to 14%, a reduction of area of 47% to 50%, and a Charpy V-notch impact toughness energy of 26 ft-lb to 28 ft-lb at room temperature.

5. The steel recited in claim 4, wherein said steel comprising by % weight of about 0.35% to 0.45% of C, about 0.1% to 1.0% of W, about 0.15% to 0.55% of V, about 0.02% to 0.15% of Ti or Nb, the presence in an amount of 9.65 max % weight of the sum of Cr, Mo, Ni, Mn, Si, and Cu, and a balance of Fe and incidental impurities, said Ni having by % weight of about 0.1% to 2.9%, said Si having by % weight of about 0.5% to 1.0%.

6. The steel recited in claim 4, wherein said steel having 11 max % wt. of retained austenite.

7. A high strength steel for armor plates, deep penetrating bombs and missiles having a microstructure comprised of dispersed titanium, vanadium, and complex tungsten carbides in a ferritic-martensitic-retained austenite matrix; said steel comprising by % weight of about 0.3% to 0.45% of C, about 0.1% to 2.0% of W, about more than 0.1% to 0.55% of V, about 0.02% to 0.2% of Ti or Nb, the presence in an amount of 9.65 max % weight of the sum of Cr, Mo, Ni, Mn, Si, and Cu, and a balance of Fe and incidental impurities, said Ni having by % weight of about 0.1% to less than 3.0%, said Si having by % weight of about more than 0.3% to 1.0%, said steel having a hardness of Rockwell C 48 to 50, an ultimate tensile strength of 240 ksi to 250 ksi, a yield strength of 225 ksi to 235 ksi, an elongation of 10% to 11%, a reduction of area of 48% to 50%, and a Charpy V-notch impact toughness energy of 20 ft-lb to 22 ft-lb at room temperature.

8. The steel recited in claim 7, wherein said steel comprising by % weight of about 0.3% to 0.4% of C, about 1.0% to 2.0% of W, about 0.35% to 0.55% of V, about 0.05% to 0.2% of Ti or Nb, the presence in an amount of 9.65 max % weight of the sum of Cr, Mo, Ni, Mn, Si, and Cu, and a balance of Fe and incidental impurities, said Ni having by % weight of about 0.1% to 1.0%, said Si having by % weight of about 0.6% to 1.0%.

9. The steel recited in claim 7, wherein said steel having by % weight of about 1.50% to 2.50% of Cr.

* * * * *